US006572245B2

(12) United States Patent
Stekelenburg

(10) Patent No.: US 6,572,245 B2
(45) Date of Patent: Jun. 3, 2003

(54) NIGHTLIGHT WITH DYNAMIC IMAGE EFFECT

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 0 days.

(21) Appl. No.: 09/983,312

(22) Filed: Oct. 24, 2001

(65) Prior Publication Data

US 2003/0076680 A1 Apr. 24, 2003

(51) Int. Cl.[7] ..... F21S 4/00
(52) U.S. Cl. ..... 362/276; 362/802; 362/35; 362/285
(58) Field of Search ..... 362/276, 802, 362/280–285, 35

(56) References Cited

U.S. PATENT DOCUMENTS 3,393,310 A * 7/1968 Ream ..... 353/4
4,288,784 A * 9/1981 Fusco ..... 250/214 R
5,442,524 A * 8/1995 Farmer ..... 362/284

* cited by examiner

*Primary Examiner*—Sandra O'Shea
*Assistant Examiner*—Ali Alavi
(74) *Attorney, Agent, or Firm*—Troxell Law Office PLLC

(57) ABSTRACT

A nightlight with a dynamic image effect comprises a plug, a sensor, a motor, a lower casing, an upper casing, a rotary seat, a lamp tube, a rotary transparent cover, and a lampshade. The rotation of motor rotor will induce a shaft to rotate to drive the rotary seat. As a result, the rotary transparent cover also rotate with the rotation of the shaft. When at night or in the places with weak illumination, the sensor will sense the condition and thus conducts. Thereby, users may view a dynamic image on the rotary transparent cover periodically.

8 Claims, 3 Drawing Sheets

NIGHTLIGHT WITH DYNAMIC IMAGE EFFECT

FIELD OF THE INVENTION

The present invention relates to nightlights, and particularly to a nightlight with a rotary transparent cover so as to present a dynamic image to viewers.

BACKGROUND OF THE INVENTION

Nightlights are widely used for providing illumination at night or dark places, even there are several nightlights in one house. To present more vivid effect, many different designs of nightlight are developed, for example, nightlights with movable frameworks for extending to user's desire places, nightlights with compact shapes for presenting beautiful outlooks, or nightlights with some other decorations. However, all these designs present a static light effect, i.e., light emitted from the nightlight is static without any variation.

Therefore, there is an eager demand for a novel nightlight which may present a dynamic image, thereby, giving a wholly new feeling to the viewers.

SUMMARY OF THE INVENTION

Accordingly, the primary object of the present invention is to provide a nightlight with a dynamic image effect to viewers, wherein a lamp tube and a rotary transparent cover rotate with the rotation of the shaft of a motor. Thereby, users may view the rotary transparent pattern from the nightlight periodically.

To achieve above objects, the present invention provides a nightlight with a rotary transparent cover for presenting a rotary transparent pattern. The nightlight comprises a plug, a sensor, a motor, a lower casing, an upper casing, a rotary seat, a lamp tube, a rotary transparent cover, and a lampshade.

At night or with weak illumination, the sensor will sense the condition and thus is conducted. Then, power is conducted to the lamp so as to make it lighting, and rotation of a motor rotor induces the shaft to rotate to drive the rotary seat. As a result, the rotary transparent cover also rotates with the rotation of the shaft of the motor. Thereby, users may view a rotary transparent pattern on the rotary transparent cover periodically.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
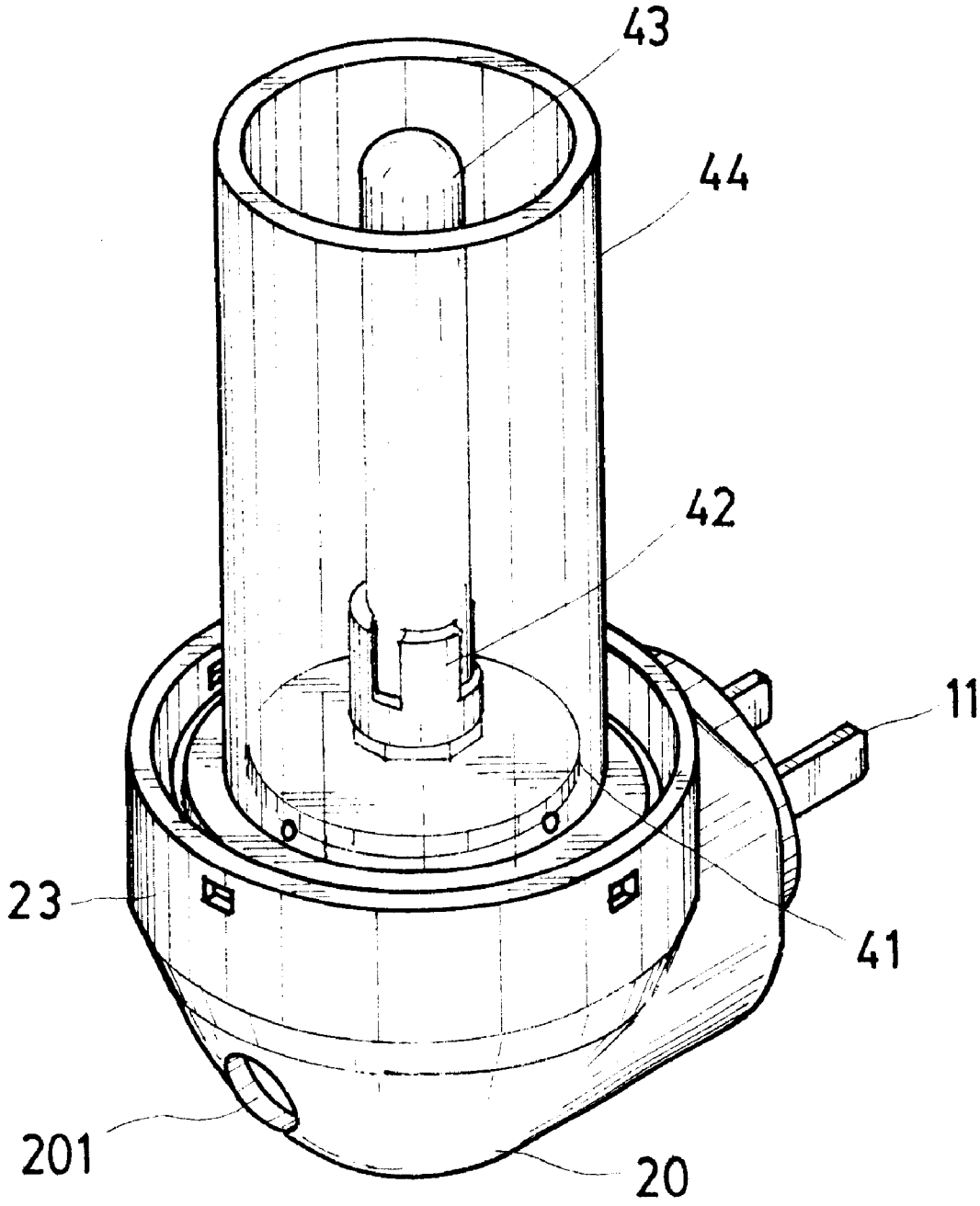
FIG. 1 is a perspective view of the nightlight of the present invention without a lampshade.
Figure 2:
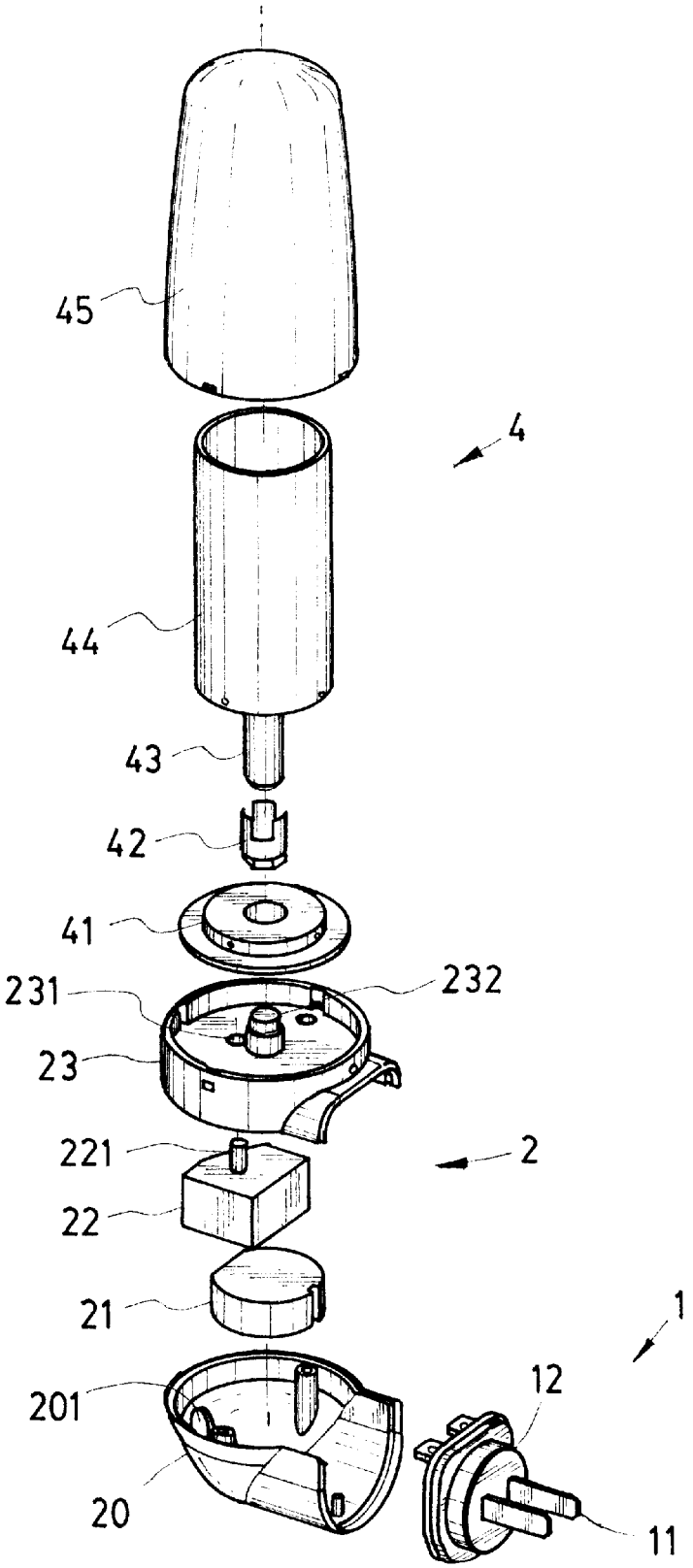
FIG. 2 is an exploded perspective view of the nightlight of the present invention.
Figure 3:
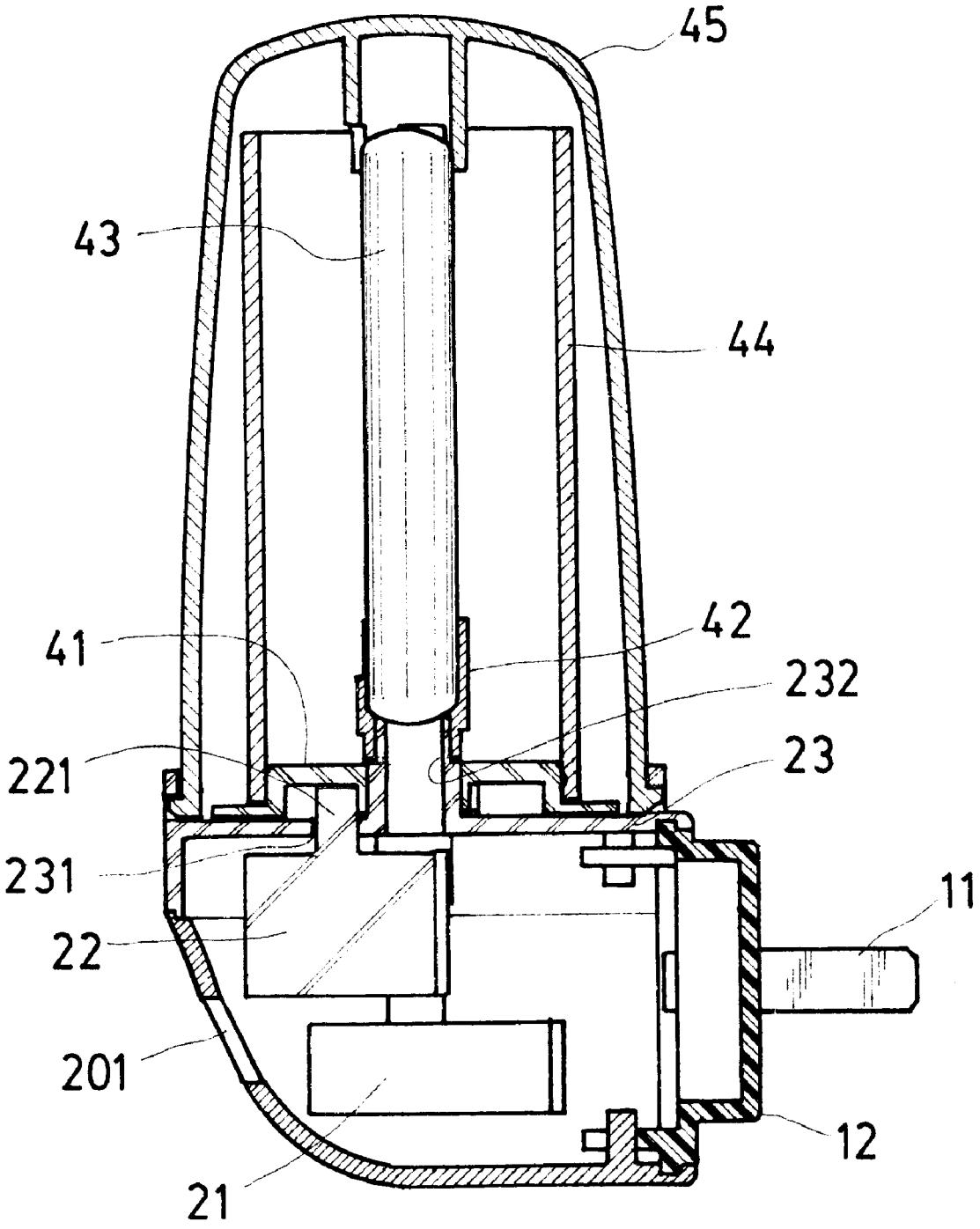
FIG. 3 shows a cross sectional view of the nightlight of the present invention.

Referring to FIGS. 1 to 3, the nightlight of the present invention is illustrated. The nightlight mainly includes a plug 1, a driving unit 2, and a lamp body 4. A preferred embodiment will be described hereinafter.

The plug 1 is mainly formed by a pair of legs 11 and a plug seat 12. The plug 1 can be inserted into a receptacle (not shown). Thereby, power is conducted into the nightlight through the plug 1. The details of the plug 1 are identical to those used in the prior art, and thus the details will not be described herein.

The driving unit 2 is mainly formed by a lower casing 20, a light sensor 21, a motor 22, and an upper casing 23. The lower casing 20 has a through hole 201. Light may transmit through the hole 201. The light sensor 21 serves to sense the light incident into the hole 201. When no light transmits through the hole 201, the light sensor 21 causes the plug 1 to conduct. The motor 22 is used as a rotation source. When power conducts, the motor 22 will be actuated to cause a shaft 221 extending from the spindle (not shown) to rotate. The lower portion of the upper casing 23 is configured to be engaged with the lower casing 20. The upper casing 23 has a though hole 231 so that the shaft 221 passes through the though hole 231.

The lamp body 4 mainly includes a rotary seat 41, a lamp seat 42, a lamp tube 43, a rotary transparent cover 44 and a lampshade 45. The rotary seat 41 is mounted above the upper casing 23 and is engaged with the shaft 221 of the motor 22. As the motor 22 rotates, the rotary seat 41 will rotate therewith. The lamp seat 42 is mounted and fixed on the guide block 232.The lamp tube 43 is fixedly engaged to the lamp seat 42 and is conducted by a power wire (not shown) through guide block 232 from the plug 1. When power is conducted, the lamp tube 43 will emit light. The rotary transparent cover 44 is rotated in the same time which engaged with the rotary seat 41 and is transparent. The rotary transparent cover 44 is made by transparent materials, for example, glass or plastic materials and has patterns thereon. The pattern may be formed with the transparent material. Furthermore, the pattern can be formed by adhering a patternized film on the rotary transparent cover 44 so that the pattern can be updated by adhering a new film thereon. Thereby, different images are presented. The lampshade 45 covers the rotary transparent cover 44 and is engaged with the upper casing 23 by screwing or other ways.

Thereby, by above components, the nightlight of the present invention is formed.

As at night or in place with weak illumination, the sensor 21 will sense the condition and thus is conducted to control the lamp lighting. The rotation of motor rotor (not shown) will induce the shaft 221 to rotate to drive the rotary seat 41. As a result, the rotary transparent cover 44 also rotate with the rotation of the shaft 221 of the motor 22. Thereby, users may view a rotary transparent pattern on the rotary transparent cover periodically.

The advantage of the present invention is to provide a dynamic image to the viewers periodically instead of static patterns as those in the prior art.

The above embodiment is only a preferred embodiment to describe the present invention, while many modifications and variations within the scopes and spirits of the present invention may be performed. All these modifications and variations are within the scopes and spirits of the present invention. For example, the lampshade 45 in above embodiment is engaged to the upper casing, while it may be engaged to lower casing or engaged by other ways. Furthermore, the sensor 21 can be replaced by a switch so that the user may actuate the nightlight manually. Moreover, the plug 1 is extended by extension wires so that the nightlight of the present invention can be placed far away from a power source.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A nightlight with a dynamic image effect comprising:

a plug for being connected to a power source;

a driving unit connected to said plug as a driving source to provide a mechanical driving force, the driving unit including a rotary seat;

a casing having the plug and the driving unit therein;

a lamp tube electrically connected to said plug and mechanically connected to the casing;

a rotary transparent cover connected to said rotary seat and having pattern thereon, said rotary transparent cover rotating with rotation of the rotary seat;

a lampshade enclosing said rotary transparent cover, wherein the lampshade is engaged with said casing;

wherein as said plug is connected to a power source, the driving unit is actuated so as to drive said rotary seat and said rotary transparent cover to rotate to present a dynamic image to viewers.

2. The nightlight with a dynamic image effect as claimed in claim 1, wherein said casing comprises an upper casing and a lower casing which are engaged with each other to enclose said plug and said driving unit therein.

3. The nightlight with a dynamic image effect as claimed in claim 1, further comprising a light sensor connected between said plug and said lamp, and said plug and said driving unit, wherein said lamp and said driving unit are actuated by said light sensor when there is weak or no ambient light.

4. The nightlight with a dynamic image effect as claimed in claim 1, wherein said driving unit is directly actuated by a power source.

5. The nightlight with a dynamic image effect as claimed in claim 1, wherein said driving unit includes a motor.

6. The nightlight with a dynamic image effect as claimed in claim 1, wherein said rotary transparent cover is made of transparent material.

7. The nightlight with a dynamic image effect as claimed in claim 6, wherein a pattern is formed in the transparent material.

8. The nightlight with a dynamic image effect as claimed in claim 6, wherein a pattern is formed by adhering a patternized film on the rotary transparent cover.

* * * * *